US005792035A

United States Patent [19]

Ward et al.

[11] Patent Number: 5,792,035

[45] Date of Patent: Aug. 11, 1998

[54] EXERCISE DEVICE FOR DOING CRUNCHES

[76] Inventors: John C. Ward, 301 E. 38th St.-Apt. 9F, New York, N.Y. 10016; Paul S. Biondi, 31 Milford La., Suffern, N.Y. 10901

[21] Appl. No.: 782,969

[22] Filed: Jan. 14, 1997

[51] Int. Cl.[6] ..... A63B 1/00

[52] U.S. Cl. ..... 482/140; 482/108; 482/106

[58] Field of Search ..... 482/140, 106, 482/108, 133, 136, 148

[56] References Cited

U.S. PATENT DOCUMENTS

| | | | |
|---|---|---|---|
| 4,066,259 | 1/1978 | Brenthan | 482/10 |
| 4,725,055 | 2/1988 | Showronski | 482/139 |
| 4,863,158 | 9/1989 | Tassone | 482/140 |
| 5,122,107 | 6/1992 | Gardner | 482/140 |
| 5,169,372 | 12/1992 | Tecco | 482/140 |
| 5,224,914 | 7/1993 | Friedman | 482/140 |

OTHER PUBLICATIONS

Iron Man, May 1983, vol. 44 No. 4 482/105 Moore's Leg Blaster.

*Primary Examiner*—Jerome Donnelly
*Attorney, Agent, or Firm*—Cobrin Gittes & Samuel

[57] ABSTRACT

An exercise device for doing crunches that has a frame that includes a head rest support to support the back of the head, two wings extending outwardly from opposite sides of the head rest support and a torso support. The wings each accommodate stacking of weights. The head rest support and the torso support cooperate with each other to stabilize the relative position of the head and neck by preventing their relative movement with respect to the upper torso.

19 Claims, 4 Drawing Sheets

EXERCISE DEVICE FOR DOING CRUNCHES

BACKGROUND OF THE INVENTION

The present invention relates to an exercise device for doing crunches to strengthen muscles in the upper and lower abdomen and back while avoiding undue stress on the muscles of the neck, head and upper body. This can optimally strengthen and tone the principal muscles in the abdominal region, specific to particular muscles and/or to portions of those muscles.

The principal abdominal muscles include the rectus abdominous. The rectus abdominous muscles are a pair of long flat muscles, on either side of the navel, which extend along the whole length of the front of the abdomen from the lower rib cage to the front of the iliac and pubic bones of the pelvis. The rectus abdominous muscles are interconnected by the Linda alba, a band of fibrous connective tissue.

The principal muscles in the back include the erector spina muscle which is composed of the iliocostalis, longissimus and spinalis muscle. These three muscles are grouped into a pair of long thick muscles running on either side of the spine for the length of the back.

The upper portion of the rectus abdominous can be effectively exercised by performing repetitions of "sit-ups" using the "crunch" technique. In this context, "crunch" refers to the motion in which the trunk of the human body is raised from a supine position, i.e., flexed, in a curling motion, while the spine is flexed so that the anterior portion of the spines convex, and with the legs remaining straight or bent.

A primary concern during abdominal exercises is the motion of the vertebrae of the spinal column. The spine is made up of 33 vertebrae which form a column. The vertebrae are conventionally divided into three regions: the cervical (upper back and neck); and, the lumbar (the lower back). Each region of the spine is responsible for implementing specific motions of the body. For instance, the cervical region provides a full range of rotation, whereas the thoracic region has limited rotation and a lumbar region has restricted rotation. The entire spine can be flexed forward through "rocking," i.e., bending the entire spine, or "crunching," i.e., hinge like movement focused at the T10-L1 region of the spine.

Problems with the spine arise when regions of the spine are subjected to stresses or motions that are inconsistent with the function of that region. For instance, excessive rotation of the lumbar region vertebrae can cause damage to the intervertebral disc. Similarly, excessive lateral loading of the cervical region can cause injury to disc. Improper movements can also over stress and fatigue related muscle groups.

Performance of "crunches" or situps can have deleterious effects on the cervical region of the spine. Unless the head is supported during these exercises, the lateral stresses on the head and neck, i.e., the hanging of the head will rapidly fatigue the muscles supporting the head. The result of the muscle fatigue is additional stress on the vertebrae and intervertebral discs.

There are few free hand exercises comparable to sit-ups or crunches which exercise the muscles in the back. Thus, individuals tend to over-exercise the abdominal muscles and under-exercise the back muscles, which can lead to discomfort and fatigue as a result of imbalanced musculature.

Therefore, to minimize the risk of injury as well as achieve a greater level of comfort and control compared to that resulting from performing free hand abdominal and back exercises, there has been a need for a device and/or technique whereby a person can perform crunch motion while performing repetitions of exercises equivalent to sit-ups, reverse sit-ups and/or knee-ups, but while remaining within safe limits of stress to the neck, back and abdominal muscles.

Various resistance-type exercise devices for exercising abdominal muscles are known. However, it has been found that when a person undertakes a program of conditioning the abdominal or back muscles by systematic use of such a device, that person often soon abandons the program because the resistance is so great as to allow performing only a few repetitions before fatigue sets in, or so small that the muscles are not adequately stressed regardless of how many repetitions are done. Even if the resistance is initially in an appropriate range for a user's muscular strength, he or she may find that as his or her muscles become stronger through exercise, that a conditioning plateau is reached where the set resistance in insufficient to provide further strengthening, thereby necessitating a need for a means to progressively increase or vary the resistance. Thus, such resistance devices are not suitable for those desiring to build-up their muscular strength beyond that attainable at the conditioning plateau.

As it is well-known, the preferred method for strengthening muscles is to exercise using progressively increasing resistance or weight because this places increasing demand on muscles and prevents them from accommodating to a specific force.

It would be desirable to provide an exercise device for doing crunches that supports the neck, head and upper body and yet avoids imposing undue stress on muscles or vertebrae and allows one to progressively increase the weight being lifted during the crunches.

SUMMARY OF THE INVENTION

One aspect of the invention resides in an exercise device having a head support to support the back of the head, two wings extending outwardly from opposite sides of the head rest support and a neck and chest support. The wings each accommodate stacking of weights. The neck and chest support and head support cooperate to stabilize the relative position of the head and neck by blocking them from bending appreciably relative to the upper torso during crunches.

BRIEF DESCRIPTION OF THE DRAWINGS

For a better understanding of the present invention, reference is made to the following description and accompanying drawings, while the scope of the invention is set forth in the appended claims.

DESCRIPTION OF THE PREFERRED EMBODIMENT

Figure 1:
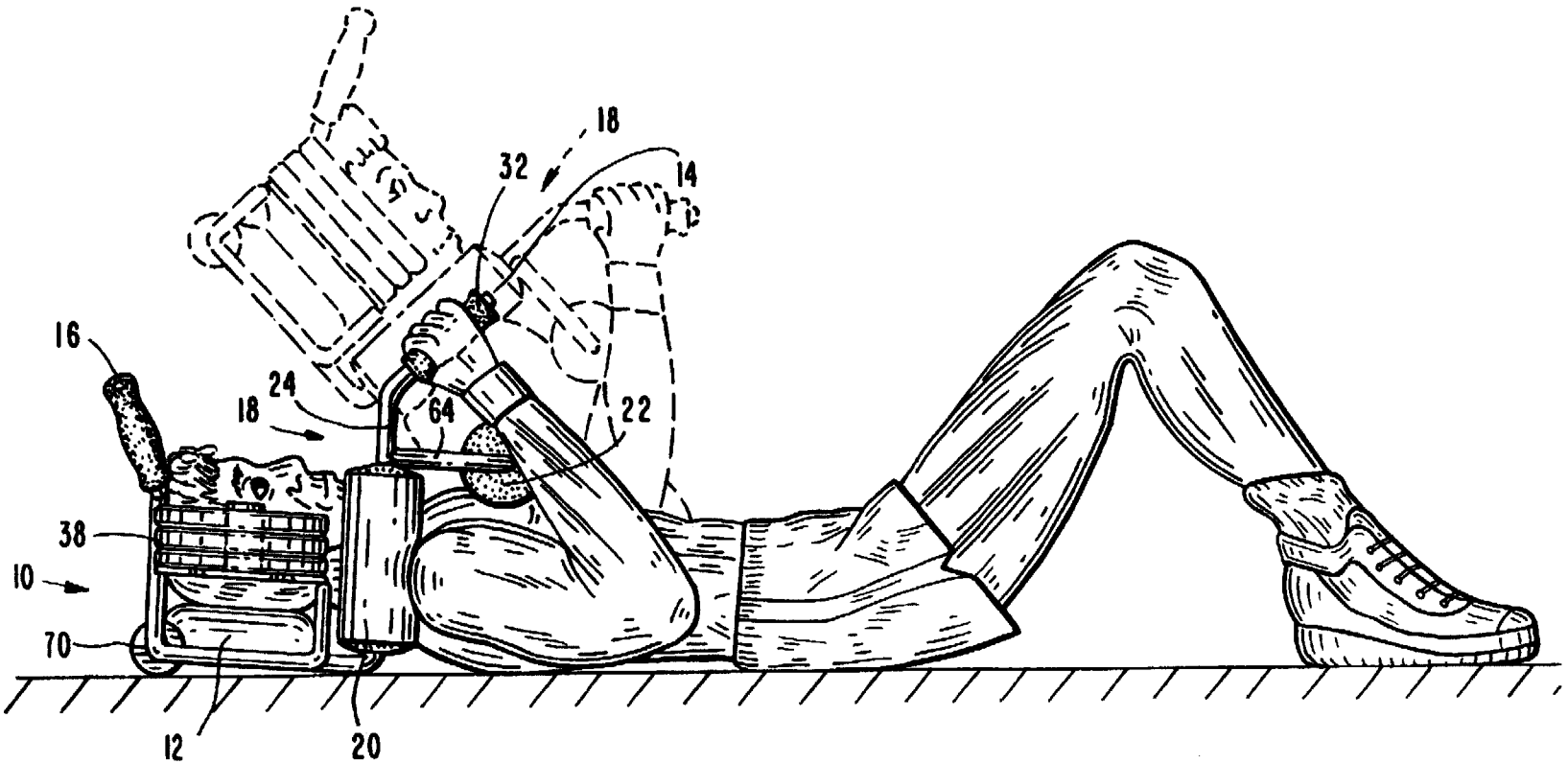
FIG. 1 is a side elevational view of the exercise device in accordance with the invention being held in position for doing crunches and shows, in phantom lines, the exercise device being raised during a crunch.

Turning to FIG. 1, the exercise device 10 in normal use is held in the manner shown while the user is in a supine position with the head resting on a head cushion 12. The user has the choice of grasping a set of handle bars 14 or 16. A cushioned chest and neck brace 18 is provided to help support the neck and head, thereby relieving stress on the head and neck muscles during performance of crunches. As the exercise device is raised, the neck remains in the same relative position with respect to the head and back as in the supine position on the floor.

Figure 2:
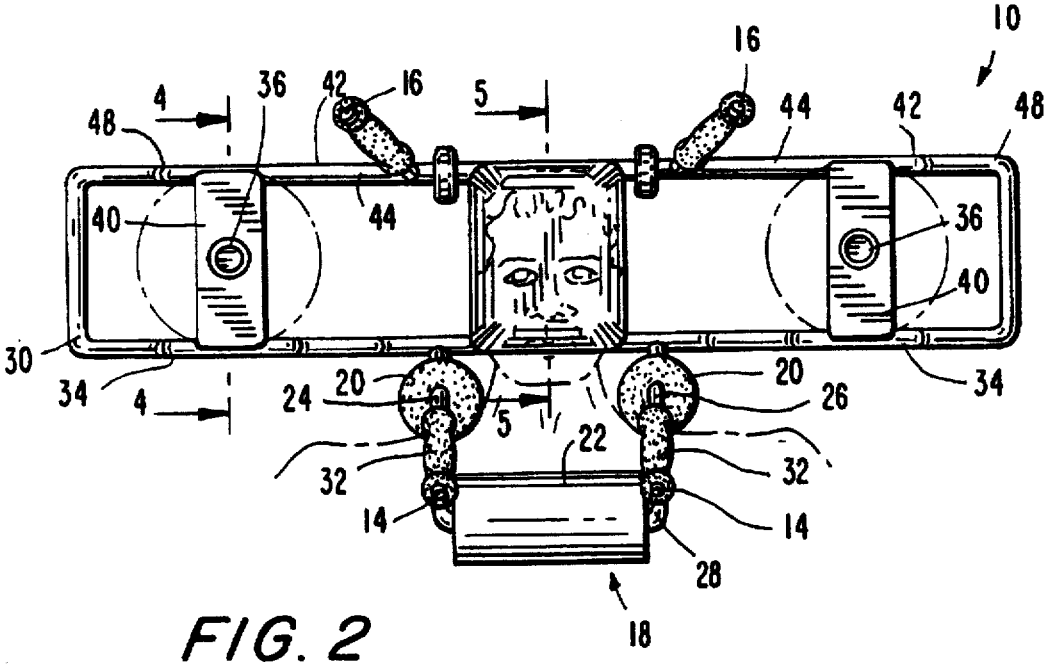
FIG. 2 shows a top view thereof.
Figure 3:
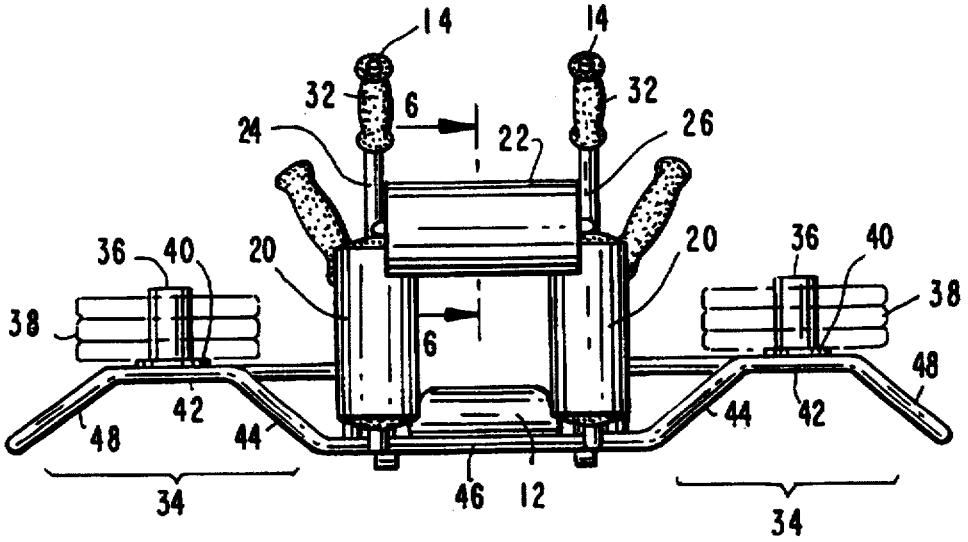
FIG. 3 is a front view thereof.

FIGS. 2–3 show the chest and neck brace 18 having two side neck cushions 20 and a transverse chest cushion 22. These cushions are held in place on corresponding bars 24, 26, 28 of a frame 30. Handle bars 14 with handgrips 32 project from above the two side neck cushions and are angled in a direction away from the head cushion 12.

The frame 30 has two wings 34 each with a tubular guide 36 around which is stacked weight plates 38 atop a weight support plate 40.

Figure 4:
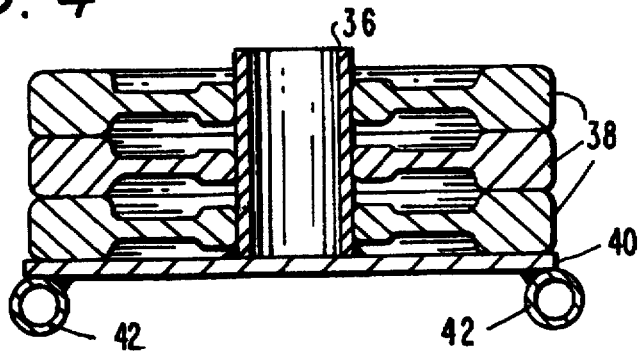
FIG. 4 is a cross-section across 4—4 of FIG. 2.
Figure 5:
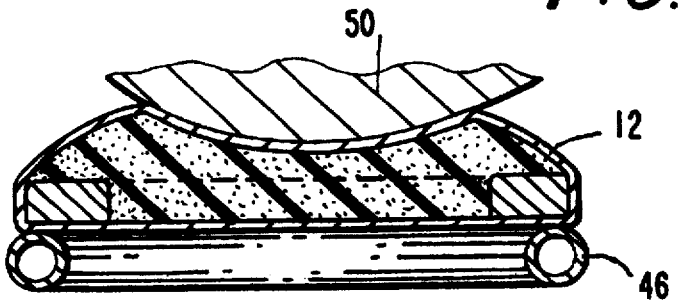
FIG. 5 is a cross-section across 5—5 of FIG. 2.

Each wing 34 includes a raised bar portion 42 at a higher elevation than the head cushion 12, a proximal bar portion 44 that extends obliquely from the head cushion support 46 to the proximal side of the raised bar portion 42, and a distal bar portion 48 that extends obliquely from the distal side of the raised bar portion 42 to a lower elevation substantially the same as that of the floor, i.e., the elevation of the underside of the head cushion support 46. The head cushion support 46 may be four bar segments arranged to form a square on whose top facing side rests the head cushion 12, as also shown in FIG. 5. The raised bar portion 42, as seen also in FIG. 4, is secured to the weight support plate 40. FIG. 5 shows the head cushion 12 being compressed by the head 50.

Figure 6:
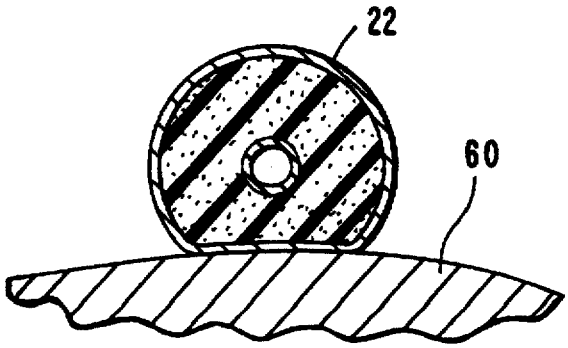
FIG. 6 is a cross-section across 6—6 of FIG. 3.
Figure 8:
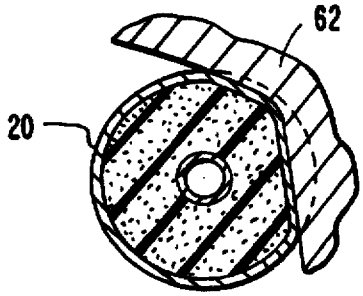
FIG. 8 is a cross-section across 8—8 of FIG. 7.

FIG. 6 shows the transverse chest cushion 22 being compressed against the chest 60 of the user. FIG. 8 shows one side neck cushion 20 being compressed against the neck 62.

Figure 7:
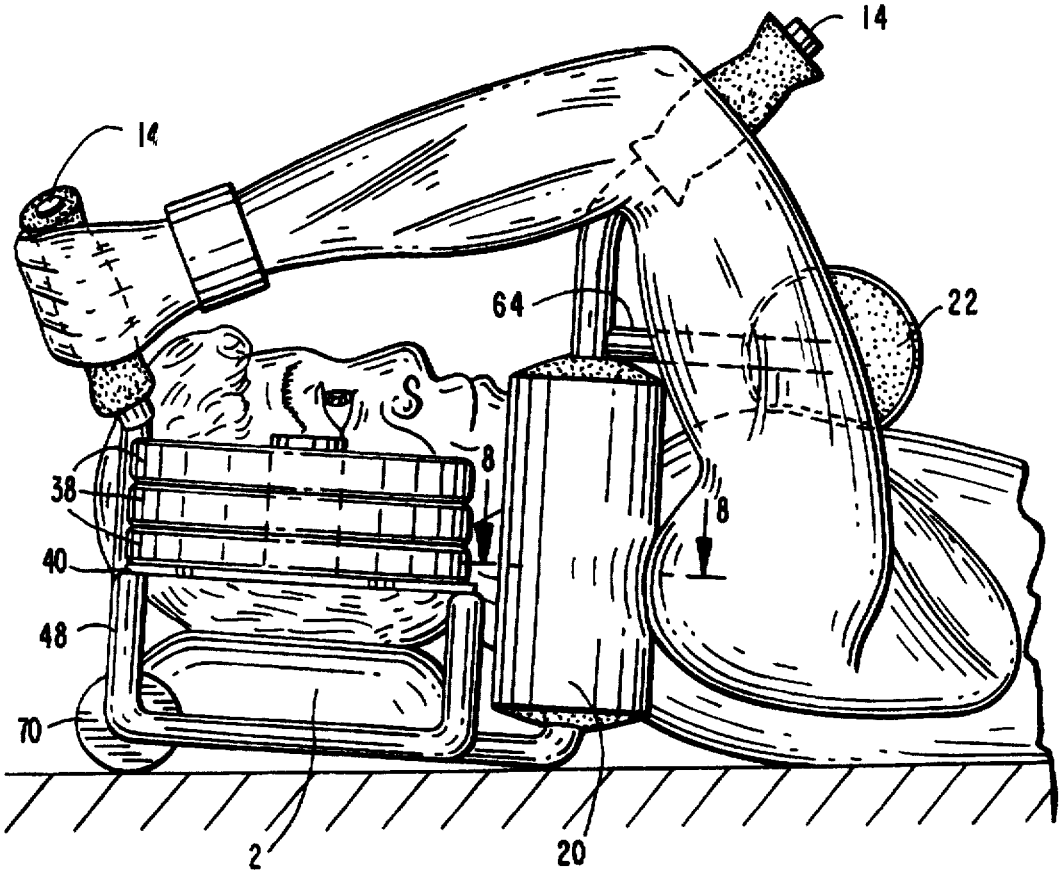
FIG. 7 is a side elevational view as in FIG. 1 except showing the user holding a different set of handles.

As best seen by comparing FIGS. 1 and 7, the user has the option of selecting the set of handlebars 14, 16 that are more comfortable for doing crunches by simply grasping the associated handgrips.

The advantage of the exercise device is that it provides a stable support of the neck and head through the use of a head cushion and neck and chest cushions. In addition, it allows weight to be added for building muscle strength as desired to the wings, yet remaining stabilized and balanced throughout performance of the crunch exercise. The raised bar portions help ensure stability even at the inception of the exercise by keeping the weight elevated. They also facilitate easy manual placement or removal of the weights from or into the stock without the fingers being pinched due to close proximity to the floor.

The bars 24, 26 may extend parallel to each other and bar 28 may extend transverse to the direction to which the bars 24, 26 extend, but bar 24 is spaced further from the head support than the bars 24, 26 by virtue of the extension 64 between, and extending perpendicular to, both bar 28 and bar 24 or 26.

Rollers 70 may be provided adjacent the head cushion support 46 to facilitate moving the exercise device along the floor. For instance, they may be arranged on the bar portion 72 that extends between the head cushion support 46 and the proximal bar portion 44, preferably at the far side of the exercise device spaced from the neck and chest brace 18. This may raise the far side and thus help angle the head cushion 12 in a manner comfortable to the user.

If desired, the distal bar portion 48 may be eliminated where the proximal bar portion 44 and raised bar portion 42 are sufficiently rigid to avoid needing the extra support for safety reasons. Alternatively, the distal bar portion 48 may be positioned instead to extend vertically directly underneath the weight support plate 40. Also, instead of being obliquely angled, the proximal bar portion 44 may instead extend vertically.

While the foregoing description and drawings represent the preferred embodiments of the present invention, it will be understood that various changes and modifications may be made without departing from the spirit and scope of the present invention.

What is claimed is:

1. An exercise device, comprising:

a frame having two wings and having a head support with a cushion having a face on which may rest a head, said head support being connected to and interposed between said wings, and a neck and chest brace connected to said frame and projecting forwardly of said front of said head support and to an elevation different from that of said head support and spaced from said wings, said two wings each projecting in opposite directions from said sides of said head support and a plurality of weight guides, at least one weight guide located on each of said wings.

2. A device as in claim 1, further comprising a cushion at said head support.

3. An exercise device, comprising:

a frame having two wings and having a head support connected to and interposed between said wings, and a neck and chest brace connected to said frame and extending from said frame and projecting forwardly of said front of said head support and to an elevation different from that of said head support and spaced from said wings, said neck and chest brace including two side members extending from said head support and a transverse member extending between said side members as viewed from said head support yet spaced more distal from said head support than said side members.

4. A device as in claim 3, further comprising a chest cushion on said transverse member.

5. A device as in claim 3, further comprising a neck cushion on each of said side members.

6. A device as in claim 3, further comprising a chest cushion on said transverse member.

7. A device as in claim 1, wherein said wings each include a raised portion at an elevation higher than that of said head support and;

wherein said wings each include an end portion spaced further from said head support than said raised portion adjacent thereto and at an elevation that is closer to that of said head support than said raised portions as said head support rests on a planar surface.

8. An exercise device comprising:

a frame having two wings and having a head support connected to and interposed between said wings, and a neck and chest brace connected to said frame and projecting forwardly of said front of said head support and to an elevation different from that of said head support and spaced from said wings, said neck and chest brace including two side members extending from a respective transition area between said head support and an associated one of said wings, said neck and chest brace also including a transverse member extending between said side members as viewed from said head support yet spaced more distal from said head support than said side members.

9. A device as in claim 8, further comprising a neck cushion on said transverse member.

10. A device as in claim 1, further comprising at least two handles each extending from said neck and chest support.

11. A device as in claim 1, further comprising at least two handles each extending from said frame from locations spaced from said neck and chest brace.

12. A device as in claim 11, wherein said locations are closer to said head support than to distal ends of said wings.

13. A device as in claim 1, wherein said wings each include a raised portion at an elevation higher than that of said head support and an end portion spaced further from said head support than said raised portion and at an elevation closer to that of said head support than said raised portion, further comprising two holders of weights each on a respective one of said raised portions, said neck and chest brace including two side members and a transverse member extending between said side members as viewed from said head support yet spaced more distal from said head support than said side members.

14. A device as in claim 13, further comprising at least two handles each extending from said neck and chest brace.

15. A device as in claim 13, further comprising at least two handles each extending from said frame from locations spaced from said neck and chest brace.

16. A device as in claim 15, wherein said locations are closer to said head support than to distal ends of said wings.

17. A device as in claim 13, wherein said side members each extend in a direction substantially parallel to each other and said transverse member extends substantially in a direction transverse to the direction to which said side members extend.

18. An exercise device, comprising:

a frame having two wings and having a head support connected to and interposed between said wings, and a neck and chest brace connected to said frame said frame and projecting forwardly of said front of said head support and to an elevation different from that of said head support and spaced from said wings, and rollers attached to said frame and arranged so that as said frame is placed on a planar surface with said rollers on said planar surface, said frame may move across the planar surface via rolling motion of said rollers.

19. An exercise device, comprising:

a frame having two wings and a head support connected to and interposed between said wings, and a neck and chest brace connected to said frame and projecting forwardly of said front of said head support and to an elevation different from that of said head support and spaced from said wings, and stacked weights one each of said wings.

* * * * *